US006529169B2

(12) United States Patent
Justice

(10) Patent No.: US 6,529,169 B2
(45) Date of Patent: Mar. 4, 2003

(54) TWIN COIL ANTENNA

(75) Inventor: Christopher M. Justice, Fortuna, CA (US)

(73) Assignee: C. Crane Company, Inc., Fortuna, CA (US)

( * ) Notice: Subject to any disclaimer, the term of this patent is extended or adjusted under 35 U.S.C. 154(b) by 0 days.

(21) Appl. No.: 09/900,317

(22) Filed: Jul. 6, 2001

(65) Prior Publication Data

US 2002/0003503 A1 Jan. 10, 2002

Related U.S. Application Data

(60) Provisional application No. 60/216,267, filed on Jul. 6, 2000.

(51) Int. Cl.[7] ..... H01Q 7/08

(52) U.S. Cl. ..... 343/788; 343/745; 343/787; 343/867

(58) Field of Search ..... 343/741, 742, 343/744, 745, 787, 788, 866, 867; H01Q 7/08

(56) References Cited

U.S. PATENT DOCUMENTS

| | | | | | |
|---|---|---|---|---|---|
| 3,665,476 | A | * | 5/1972 | Taylor | 343/701 |
| 4,101,899 | A | * | 7/1978 | Jones et al. | 343/788 |
| 4,712,112 | A | * | 12/1987 | Carr | 344/788 |
| 4,928,108 | A | * | 5/1990 | Kropielnicki et al. | 343/704 |
| 5,084,699 | A | * | 1/1992 | DeMichele | 340/825.54 |
| 5,420,579 | A | | 5/1995 | Urbas | |
| 5,767,816 | A | * | 6/1998 | Cosman | 343/788 |
| 6,163,305 | A | | 12/2000 | Murakami et al. | |
| 6,172,608 | B1 | * | 1/2002 | Cole | 340/572.1 |

* cited by examiner

*Primary Examiner*—Tho Phan
(74) *Attorney, Agent, or Firm*—Gray, Cary, Ware & Freidenrich

(57) ABSTRACT

A ferrite core antenna having two spaced signal pick-up coils coupled through a transformer so that the signals from the two coils are additively combined in the primary of the transformer. A variable capacitor connected to the two coils tunes the antenna to selected frequencies. This results in amplification of the signal.

13 Claims, 4 Drawing Sheets

TWIN COIL ANTENNA

This application claims benefit of Provisional application Ser. No. 60/216,267, filed Jul. 6, 2000.

TECHNICAL FIELD

The invention relates to an active ferrite core radio receiver antenna combined with an inductive and capacitance network for receiving and conveying signal energy between the active antenna and receiver. The active antenna comprises a resonant circuit which is electronically tunable to a frequency of interest.

BACKGROUND OF THE INVENTION

Ferrite core antennas are widely used as antennas for radio receivers, particularly for AM broadcast band radios, to increase radiation resistance over that simple Hertzian dipole antenna. This is done by forming the conducting element of the antenna in a coil or loop, and placing a ferrite body inside the loop. The ferrite has the effect of concentrating and intensifying the received magnetic field inside the loop. This is the result of the high permeability, $\mu$, of the ferrite material. The incorporation of ferrite into the antenna coil is most easily accomplished by winding the antenna coil around the ferrite rod.

The use of a ferrite rod increases the loop's radiation resistance by a factor of $\mu_e^2$, where $\mu_e$, is the ferrite's effective magnetic permeability. Typically, for frequencies in the 100 to 2000 kHz range, the value of $\mu_e$ for typical ferrites is from about 100 to about 10,000. Thus, for a value of $\mu_e$ of, e.g., 1,000, ferrite can increase the antenna's radiation resistance, over a Hertzian dipole, by a factor of 1,000,000.

The ferrite core or rod itself tends to absorb some of the signal power. This represents the work done in "flipping" the alignment of the magnetic domains inside the core with each signal element. This ferrite rod "ferrite resistance" adds resistance in series with the antenna. Even with this added resistance, the antenna's resistance is typically just a few ohms, or even one ohm or less. However, in operation, the antenna must be coupled to a large impedance of the receiver electronics. This is usually accomplished by adding a capacitor to turn the antenna loop into a resonant circuit.

However, when a signal enters a ferrite rod antenna that is tuned to resonance with a coil and capacitor, the magnetic lines of flux begin to saturate. This is due to sympathetic resonance. Sympathetic resonance is much like setting two guitars close to each other and plucking the string on one of the guitars. If both strings are tuned the same, the plucked string sound waves will cause the corresponding string on the other guitar to vibrate identically. When this saturation occurs in a ferrite core antenna, the ferrite rod antenna takes on polarity, much like a standard magnet. Ferrite antennas of the prior art have only one pick-up coil, and this coil receives the sympathetic resonance from only one-half of the ferrite rod. This results in loss of efficiency and limits the signal-to-noise ratio available to the receiver electronics.

Thus, there is a need for improved efficiency and a higher signal-to-noise ratio antenna that does not saturate at high frequencies, and it is to these ends that the present invention is directed.

SUMMARY OF THE INVENTION

The invention provides an antenna for a radio receiver that has high efficiency, high signal-to-noise ratio and that does not saturate at high frequencies. This is accomplished by an antenna structure which employs a ferrite core having two (or more) coils coupled together and located on the ferrite core such that the magnetic fields coupled to the coils induce signals which combine to produce a resulting signal level equivalent to the combined signals in the coils. The coils may be coupled through a transformer where the combined signals of the coils are received in the primary of the transformer. The transformer coupling the antenna coils can dramatically narrow the bandwidth of the received signal. In addition, the antenna coils and the transformer windings may be connected to a capacitor to form a resonant circuit. The capacitor may be variable so the resonant frequency of the antenna may be set by tuning the capacitor. This results in an increased signal level and reduced interference and noise.

DETAILED DESCRIPTION OF PREFERRED EMBODIMENTS

The invention is particularly applicable to antennas used with conventional radio receivers for use in low frequency (LF), mid-wave (MW) frequency, and high frequency (HF) bands, and will be described in that context. By proper selection of materials and components, the invention may also be used with radio receivers operating at VHF and UHF frequencies. It will be appreciated, however, that these uses are illustrative of only one utility of the invention.

Figure 1:
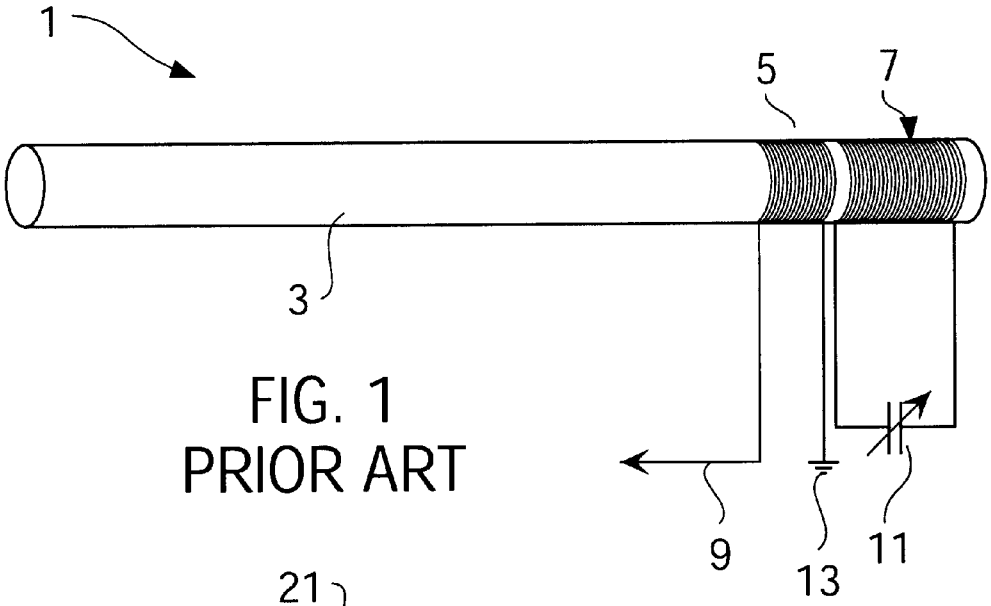
FIG. 1 PRIOR ART
FIG. 1 shows a conventional ferrite core antenna of the prior art.

FIG. 1 illustrated a conventional known ferrite rod antenna 1 such as may be used in a conventional AM broadcast band radio receiver. As shown, the antenna may comprise an elongated ferrite rod 3 which has an RF tuning coil 7 wound about one end of the rod. A second pick-up coil 5 may be wound around the rod adjacent to the RF tuning coil. One end of the pick-up coil may be grounded as shown at 13. The other end 9 of the pick-up coil provides the output signal. The RF tuning coil may be connected in parallel with a tuning capacitor 11 to form a resonant circuit which may be tuned to desired frequencies of interest. In operation, the ferrite rod concentrates the magnetic field inside of the tuning coil 7 at the frequency to which the resonant circuit is tuned. The energy in the RF tuning coil is coupled by transformer action and sympathetic resonance to pick-up coil 5 which outputs the signal at 9 to the radio receiver. As described previously, since the antenna 1 uses only one pick-up coil and only one-half of the ferrite rod, it exhibits low efficiency and low signal-to-noise ratio.

In contrast, the invention provides a multiple coil ferrite antenna that provides high efficiency and high signal-to-noise ratio. As a result, it affords substantially better radio reception than conventional ferrite rod antennas of the type illustrated in FIG. 1. As will be explained in more detail below, the invention employs two or more spaced coils on a ferrite core. Magnetic fields inside of the ferrite core induce signals in the spaced coils. The coils are coupled to a combiner which combines the signals additively from the spaced coils to provide a significantly higher signal level to the radio receiver. Preferably, was will be described below, the combiner comprises a transformer with the primary of the transformer connected to the spaced coils. The coils may also be connected to a variable capacitor to form a tuned resonant circuit, with the frequency of resonance determined by the combined inductance of the coils and the transformer. Each coil is used for both tuning and for pick-up. The signals from each coil are opposite in phase but are combined additively in the primary of the transformer to result in a significantly higher received RF signal. Tuning the antenna by means of the variable capacitor significantly enhances signal-to-noise ratio since it reduces the effective bandwidth of the antenna to discriminate against interfering signals and reduce the noise coupled to the receiver.

Figure 2:
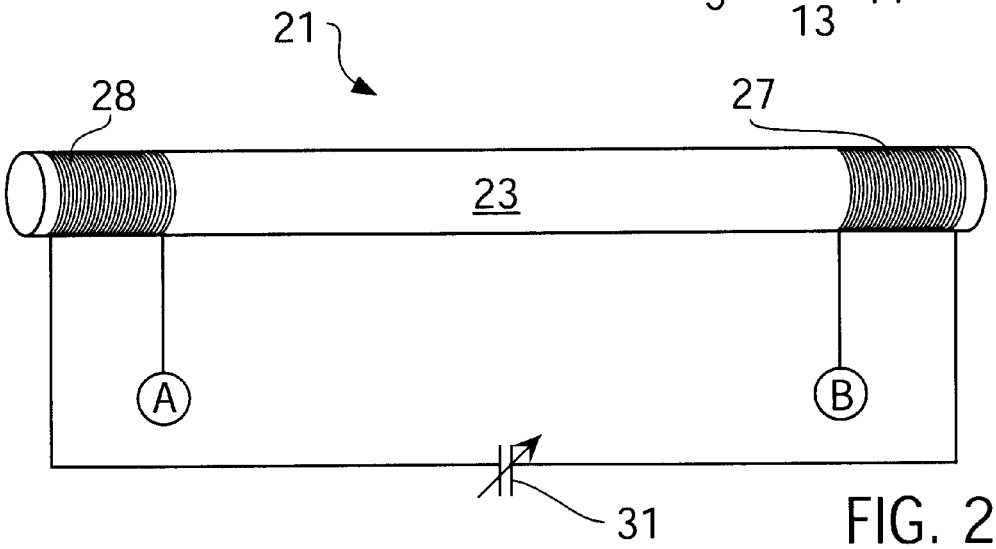
FIG. 2 shows a ferrite rod antenna with a pair of coils coupled through a tuning capacitor, and the coils being 180 degrees out of phase.
Figure 3:
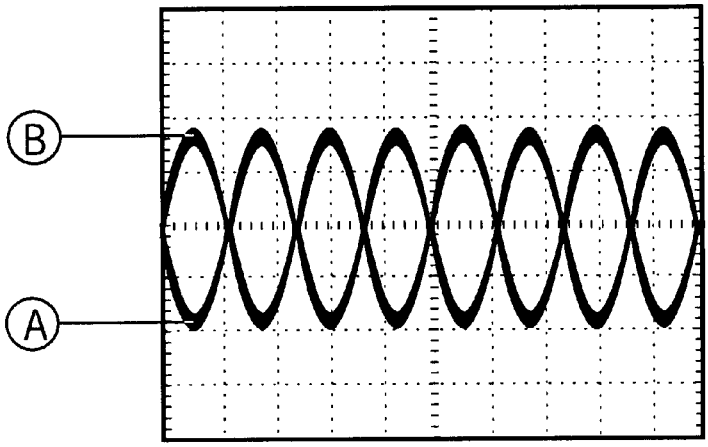
FIG. 3 shows a representation of the signals at the outputs of the windings of the antenna shown in FIG. 2.

FIGS. 2 and 3 show a ferrite rod antenna, 21, having two spaced coils, 27, 28 wound about a ferrite rod 23 adjacent opposite ends of the rod, and connected to a variable tuning capacitor 31. One coil 27 receives 0–180 degrees of the incoming signal, e.g., an unmodulated sine wave, and the other coil 28 receives 180–0 degrees of the incoming signal. Thus, the signals on terminals A and B from coils 27 and 28 are inverted and out of phase as shown in FIG. 3, where the combined waveforms from terminals A and B have a resultant of 0 volts peak-to-peak. Thus, in the arrangement of FIG. 2, the signals effectively cancel themselves out because the RF potential between the two coils becomes zero volts when the signals are combined, i.e., the signals subtract as indicated in the view of the waveforms in FIG. 3.

Figure 4:
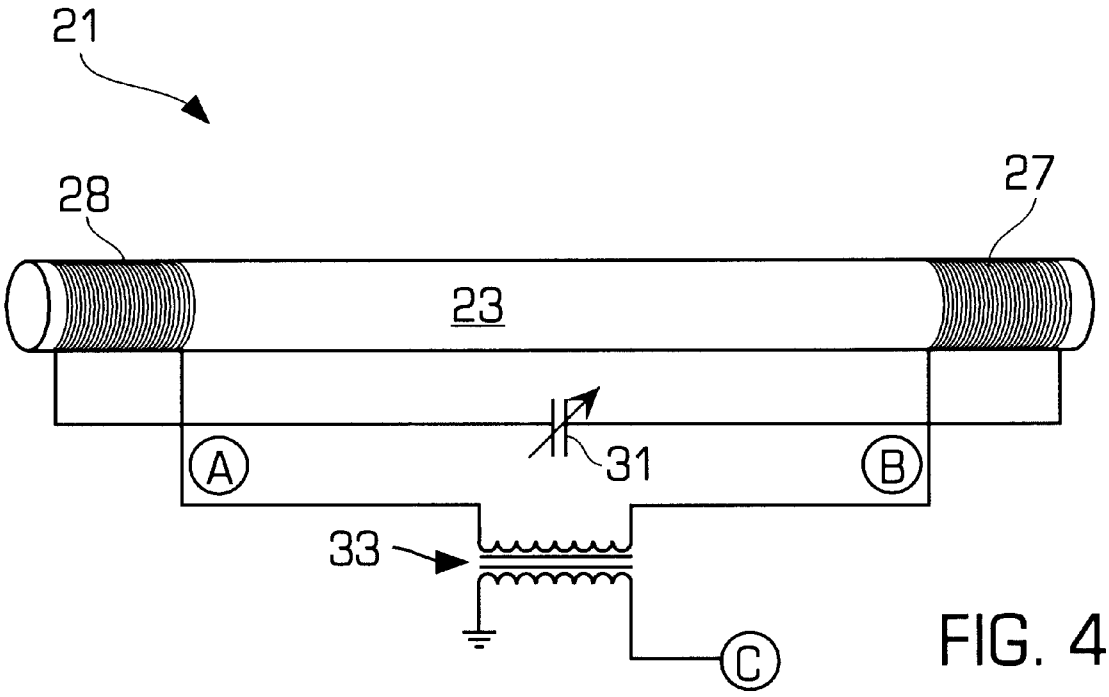
FIG. 4 shows an embodiment of a ferrite rod antenna of the invention having a pair of coils, coupled through a variable tuning capacitor and a transformer, where the tuning capacitor and the transformer are electrically in parallel.
Figure 5:
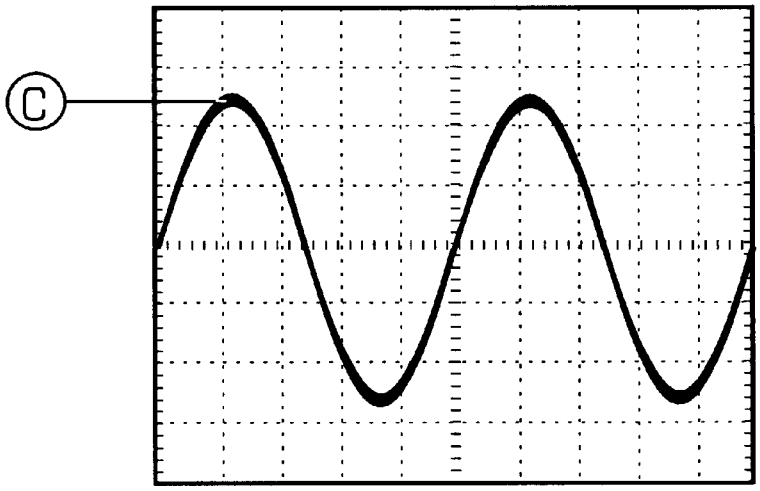
FIG. 5 shows a representation of the signals at the output of the transformer of the antenna shown in FIG. 4.

By way of contrast and comparison, in a twin coil antenna according to the invention, the signals are combined so as to be additive. This is shown in FIGS. 4 and 5 where the signals from the coils 27, 28 are combined through the primary of a transformer 33. As an example, coils, 27 and 28, may be 40 turns of 12 strand Litz wire, 12 mm diameter, inserted over the ends of the ferrite rod. The winding rotation is in the same direction on both coils, i.e., coil 27 has right hand rotation and coil 28 has right hand rotation on the windings. The total inductance ($L_1$) of the circuit of FIG. 4 is the totals inductance of coils 27 and 28 and the transformer 33. The antenna 21 of FIG. 4 is resonant at the frequency set by the total inductance and the capacitance (C) of tuning capacitor 31. These elements form an LC resonant circuit. The invention produces a significant increase in signal strength over a conventional ferrite antenna.

The secondary of transformer 33 serves two purposes. First, it is the signal pick-up coil for the transformer 33, and, second, it also limits the output bandwidth of the signal. Varying the inductance of the secondary winding of transformer will correspondingly make the output signal bandwidth greater or narrower. A narrower bandwidth increases the amplitude, reduces the noise and interference, and results in greater signal to noise ratio and more overall gain at the frequency to which the antenna is tuned.

The type of ferrite used will vary depending on the operating frequency desired. There are many types of ferrite available, as is well known to those skilled in the art, and one may be selected that has the best saturation and permeability in the operating frequency range of interest. By proper selection of the ferrite material to saturate at VHF and UHF frequencies, and by matching the inductances, ferrite material and coupling transformer, the antenna of the invention may also be used at VHF and UHF frequencies.

The antenna of the invention can be incorporated into any receiver that uses or is designed for use with a conventional ferrite rod antenna, e.g., for reception of any LW, MW, HF, VHF and UHF frequency band signals. Also, from the foregoing, it will be recognized that additional refinements can be made in the antenna to enable it to be used for other frequencies, since the operating frequency bandwidth can easily be manipulated by adjusting the inductance of the secondary transformer 33. The antenna can be used easily as a replacement unit to improve reception on any conventional radio receiver that has LW, MW, HF, VHF and UHF frequency bands, and also has applications for other frequencies.

Figure 6:
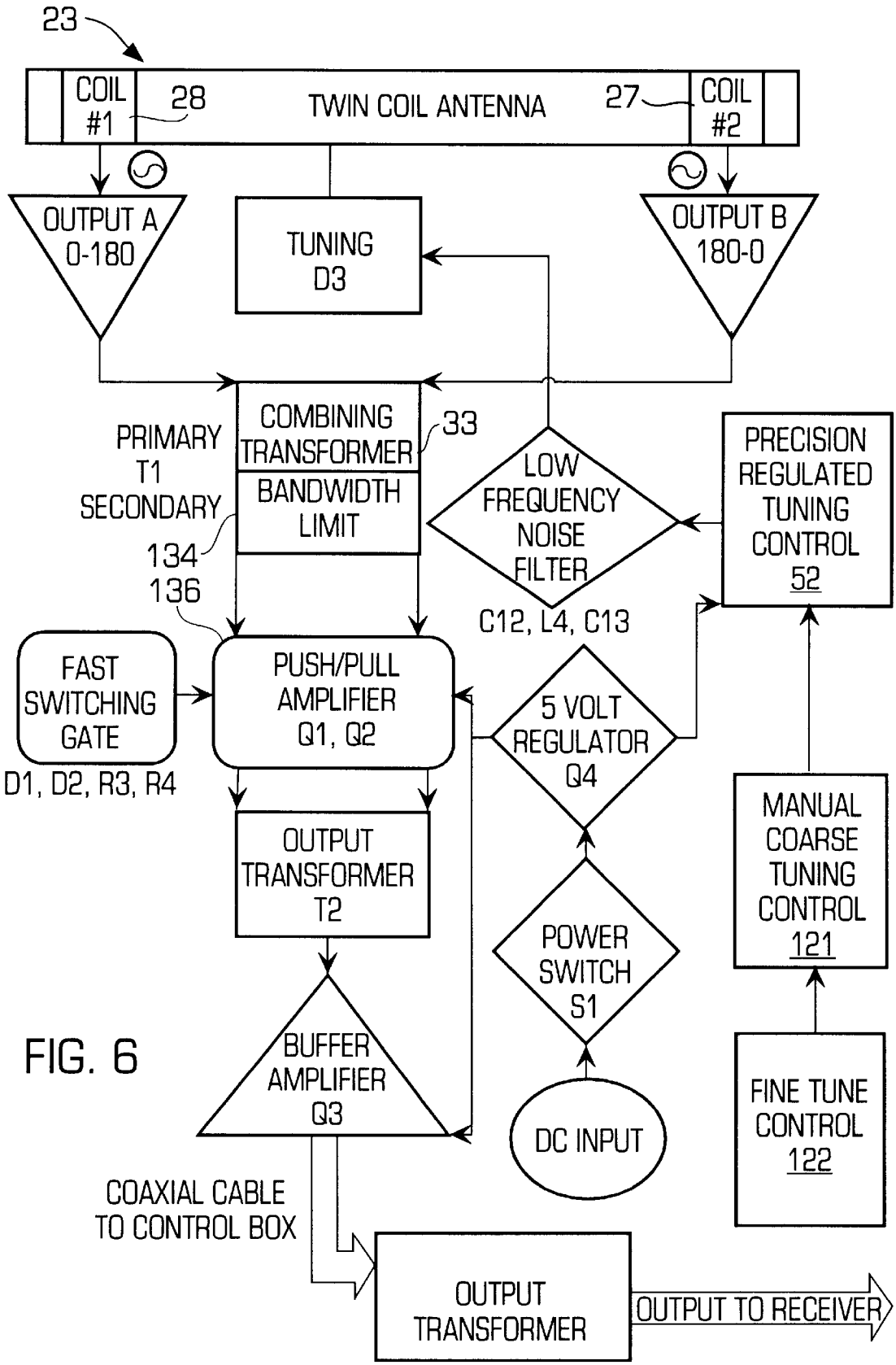
FIG. 6 is a block diagram of another embodiment of an antenna of the invention, the figure showing the antenna coupled to associated electronics.
Figure 7:
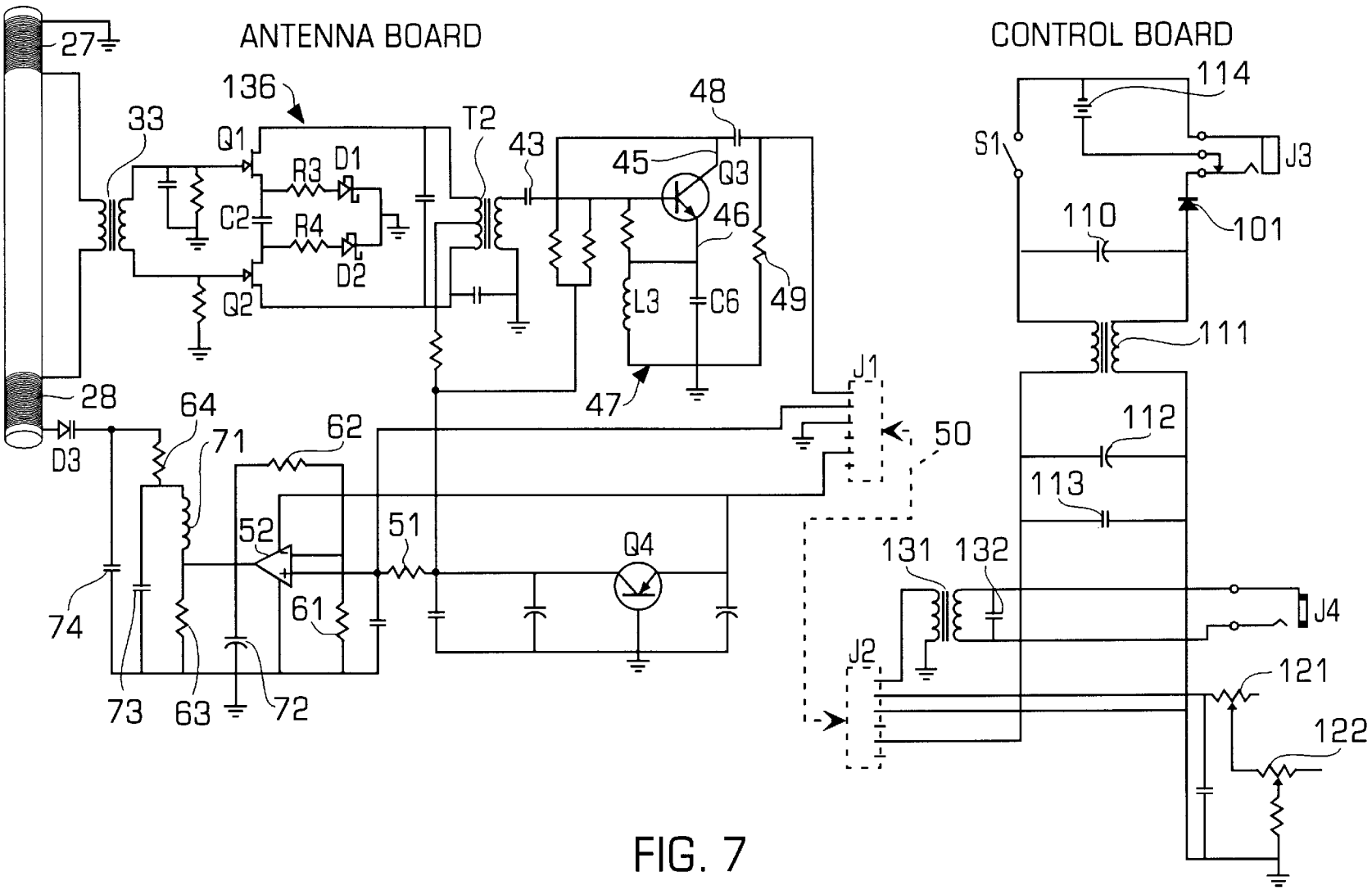
FIG. 7 is a circuit diagram of the antenna of FIG. 6.

A ferrite core antenna according to a preferred embodiment of the invention is shown in FIGS. 6 and 7. FIG. 6 is a functional block diagram of the antenna and associated electronics, and FIG. 7 is a more detailed circuit diagram of an example of the antenna of FIG. 6. For purposes of illustration, the circuit is shown disposed on two boards, an Antenna board and a Control board connected by a cable 50. It will be appreciated, however, that a single board may also be used. The illustrated embodiment in FIGS. 6 and 7 is intended for the MW broadcast band, but it will be appreciated that the principles may be readily extended to other frequency bands.

As shown in the FIGURES, the signal from transformer 33 may be fed into a J-FET push/pull amplifier 136, comprising transistors Q1 and Q2, resistors R3 and R4, and hot carrier diodes D1 and D2, for linear amplification of the signal. Hot carrier diodes are preferably used on the drains of the FETs for an ultra-quick discharge of the capacitor C2 connecting the drains of Q1 and Q2. There results a noticeable improvement in bandwidth and improved AM amplification when the hot carrier diodes were used. The outputs from the sources of transistors Q1, Q2 of the push-pull amplifier 136 are supplied to a transformer T2. Transformer T2 is preferably a center tapped transformer that feeds voltage from a power supply to the sources of the J-FETs. The signal is amplified and the combined output of the amplifiers can be seen on the secondary of Transformer T2.

The output of transformer T2 is sent through a capacitor 43 and then to transistor Q3 which is used as a buffer amplifier to drive low impedance applications. The emitter 46 of transistor Q3 goes through a filter 47 comprising an inductor L3 and capacitor C6 to eliminate low frequency oscillations. The collector 45 output of transistor Q3 goes through a capacitor 48 for decoupling and to a 330-ohm resistor 49 for impedance matching and to eliminate feedback in a cable 50 connected to a jack J1. The signal from transistor Q3 and capacitor 48 is the combined output signals from coils 27 and 28.

The output signal from Q3 is driven through the cable 50 and may be terminated in a toroid transformer 131 on the control board. The output of this toroid transformer is matched to drive the front-end of the receiver directly or it may be inductively coupled to a receiver's existing ferrite antenna using a plug-in ferrite bar antenna.

The antenna is tuned electronically with a voltage controlled variable capacitance varactor diode D3 through a network of components that keep the tuning voltage stable and accurate even in the presence of a varying DC power supply voltage and induced RF through the connecting cable. The reference voltage for the tuning may be taken from a transistor Q4, which serves as a 5-volt regulator. The regulated 5 volts from Q4 may be fed through a 56 k ohms 51 which is in series with variable resistors 121 and 122 on the control board, and to the in put of an operational amplifier 52. Variable resistors 121 and 122, may have values of 100 k ohms and 5 k ohms, respectively, serve as manual coarse and fine tuning controls for the varactor diode D3, and act together with resistor 51 as a very stable voltage divider. The output of the voltage divider is directly fed into the operational amplifier's non-inverting (+) input. Resistors 61 and 62 form another voltage divider and give feedback to the inverting (−) input of amplifier 52 to allow greater voltage range that is fully regulated at the output. A resistor 63 is a load resistor on the output of the amplifier for stability. This output voltage is fed into a low frequency RF filter comprising a capacitor 72, inductor 74 and capacitor 73. The voltage to the cathode of varactor diode D3 may be supplied through a resistor 64 (100 k ohms) and capacitor 74. The anode of the varactor is directly coupled to winding 28 and ultimately to ground through transformer 33 and winding 27. As the voltage from amplifier 52 varies in response to the tuning controls 121 and 122, the capacitance of the varactor varies and tunes the resonant circuit. Using this regulated tuning method shown, the voltage input into the device can vary from, e.g., 6.5 to 12 volts, and the antenna tuning will remain exactly where the user preset the frequency.

The control board may contain few components used principally to supply voltage and user interface to the device. As noted above, the central board may be connected to the antenna board via jacks J1 and J2 and cable 50. Diode 101 may be a standard diode that protects the unit from reverse polarity voltage at jack J3. Switch S1 is a simple on/off switch. Capacitors 110, 112, and 113 and torroid transformer III are DC line filters, mainly used when the device is plugged into an external DC source via jack J3. Normally, DC power may be supplied by a battery 114. Variable resisters 121 and 122, which may be 100 k ohms and 5 k ohms potentiometers, serve as coarse and fine tuning controls for the varactor as described above. R101 is a preset resistor to keep the voltage on the varactor pre-tuned to a specific frequency. Transformer 131, which receives the output signal from Q3, and capacitor 132 are used for the termination transformer and impedance matching. This is the final stage of the device before a clean, amplified signal is delivered to the receiver via jack J4.

A preferred embodiment of the invention as described herein comprises a ferrite core antenna, characterized by two spaced windings. The two windings are connected through a combiner, for example, the primary winding of a transformer which additionally combines the signals from the two coils to produce an increased output signal level. Preferably, the antenna is resonant at the frequency of interest, and the resonant frequency of the antenna is set by a tuning capacitor.

What is claimed is:

1. An antenna for a radio receiver comprising a ferrite rod; spaced coils wound about the ferrite rod; a variable capacitor element connecting each coil together; and a combiner connecting each coil together, the combiner additively combining out-of-phase signals induced in the coils by received radio signals so as to provide an output signal corresponding to the sum of the out-of-phase signals in the coils.

2. The antenna of claim 1, wherein said combiner comprises a transformer.

3. The antenna of claim 2, wherein the out-of-phase signals from the coils are connected to opposite ends of a primary winding of said transformer, and said output signal is supplied from a secondary winding of said transformer.

4. The antenna of claim 3, wherein said coils, said transformer and said variable capacitor form a resonant circuit which is tuned by said variable capacitor.

5. The antenna of claim 4, wherein said variable capacitor has a capacitance value which is electronically variable.

6. The antenna of claim 5 further comprising an amplifier for amplifying the output signal and for supplying the output signal to the radio receiver, and a variable voltage source connected to said variable capacitor for tuning the antenna to selected operating frequencies.

7. An antenna for a radio receiver comprising a ferrite rod; spaced pick-up coils wound about the ferrite rod, signals being induced in the pick-up coils by received magnetic fields in the ferrite rod, the signals being of opposite phase; and a combiner connected to the coils for additively combining the opposite phase signals induced in the coils to provide an output signal corresponding to the sum of said opposite phase signals.

8. The antenna of claim 7, wherein said combiner comprises a transformer.

9. The antenna of claim 8, wherein the opposite phase signals from the coils are connected to opposite ends of a primary winding of said transformer, and said output signal is supplied from a secondary winding of said transformer.

10. The antenna of claim 9 further comprising a variable capacitor connected to the pick-up coils, the pick-up coils, the transformer and the variable capacitor forming a resonant circuit, and the variable capacitor tuning the resonant circuit to selected frequencies.

11. The antenna of claim 10, wherein a first one of said pick-up coils has one end grounded, another end connected through the primary winding of said transformer to a second one of said pick-up coils, and said second pick-up coil is connected said variable capacitor.

12. The antenna of claim 11, wherein said variable capacitor is an electronically variable varactor diode. electronically variable varactor diode.

13. The antenna of claim 12 further comprising an amplifier for receiving the output signal from said transformer and for providing an amplified output signal; and a variable voltage source connected to the variable capacitor for tuning the antenna.

* * * * *